United States Patent [19]

Bennett et al.

[11] 4,342,495

[45] Aug. 3, 1982

[54] DOUBLE ENTRY CRIMP TERMINAL

[75] Inventors: Benny M. Bennett; Timothy L. Kocher, both of Harrisburg, Pa.; David M. Little, Harrisonburg, Va.

[73] Assignee: AMP Incorporated, Harrisburg, Pa.

[21] Appl. No.: 54,723

[22] Filed: Jul. 5, 1979

[51] Int. Cl.[3] ..... H01R 23/04

[52] U.S. Cl. ..... 339/163

[58] Field of Search ..... 339/153-156, 339/163, 176 M, 191 M, 276 T, 108 TP, 205

[56] References Cited

U.S. PATENT DOCUMENTS

| | | | |
|---|---|---|---|
| Re. 26,646 | 8/1969 | Evans | 29/190 |
| Re. 26,837 | 3/1970 | Evans | 317/101 |
| 3,546,664 | 12/1970 | De Bolt et al. | 339/256 |
| 3,548,367 | 12/1970 | Bruetsch | 339/205 |
| 3,601,785 | 8/1971 | Longenecker | 339/256 |
| 3,842,391 | 10/1974 | Dechelette | 339/32 R |
| 4,037,906 | 7/1977 | Jayne | 339/107 |
| 4,083,615 | 4/1978 | Volinskie | 339/176 M X |
| 4,168,877 | 9/1979 | Little et al. | 339/103 M |
| 4,252,399 | 2/1981 | Bauerle | 339/217 S X |

*Primary Examiner*—Joseph H. McGlynn
*Assistant Examiner*—Frank H. McKenzie, Jr.
*Attorney, Agent, or Firm*—Russell J. Egan

[57] ABSTRACT

An improved double entry crimp terminal is disclosed. The subject terminal has a receptacle portion on each end thereof and a crimp barrel intermediate the ends so that the terminal can be crimp connected to a conductor and one receptacle used as the main mating portion with the oppositely directed receptacle providing the ability to probe the terminal when in a mounted and mated condition within an electrical connector system.

10 Claims, 2 Drawing Figures

DOUBLE ENTRY CRIMP TERMINAL

BACKGROUND OF THE INVENTION

1. The Field of the Invention

The present invention relates to a double entry electrical terminal and in particular to a terminal which can be probed while in the mounted and mated condition.

2. The Prior Art

There are often times in the electrical industry when it is desirable to probe and test the terminals of a connector assembly to assure electrical continuity and the presence of proper voltages. It is not always possible to accomplish such probing and testing because of the design of the connector itself and in particular the design of the terminals used within the connector. For example, the connector of U.S. Pat. No. 4,037,906 is so formed that it would be extremely difficult to attempt to probe the terminals with the connector in a mated condition.

A connector assembly is shown in U.S. Pat. No. 4,168,877 which shows an electrical connector having a housing formed so that it is possible to probe the terminals mounted therein while the connector is in a mated condition. Each of the terminals disclosed in the noted patent has three portions namely, a terminal pin engaging receptacle portion at one end, a conduction engaging intermediate crimp barrel portion and a probe engaging tail portion. It will also be noted from FIG. 3 of this patent that the terminals can be positioned in the housing in an intermating nose to tail fashion with the tail portion of the second terminal extending from the cover of the housing. Thus it is possible with this connector to either insert a probe through the cover to accomplish the electrical testing or to have the tail of the terminal exposed where it can be more readily engaged by test equipment.

The above described connector assembly is not entirely without disadvantages in that it is costly to double up on the number of terminals that are used in the assembly, especially when the need for probing would normally be infrequent at the best. It also would be a disadvantage to have the tail portions of the second terminals exposed from the connector in a manner which might be hazardous to those working in the immediate vicinity of the connector.

SUMMARY OF THE INVENTION

The present invention concerns an electrical terminal which enables probing the terminals of a mated connector. The subject terminal has a first mating receptacle on one end, a probe receptacle on the opposite end, and a crimp barrel intermediate the ends. The first mating receptacle is of a well known configuration and is an entire closed box including means for latchingly mounting the terminal in an appropriate housing. The crimp barrel portion includes a first pair of crimping tines for engaging the wire of a conductor while a second pair of crimp tines engage the insulation of the conductor in a strain relieving fashion. The probe receptacle can be a simple configuration of a pair of inwardly directed beams sufficient to make electrical and mechanical contact with a probe member inserted therein.

It is therefore an object of the present invention to produce an improved double ended electrical connector terminal which will allow for test probing of the terminal in a fully assembled and fully mated condition of the associated connector.

It is a further object of the present invention to produce an improved electrical connector having a mating receptacle on a first end, a crimp barrel intermediate the ends and a probe receptacle on the other end.

It is yet another object of the present invention to teach a double ended electrical connector which can be readily and economically produced.

The means for accomplishing the foregoing objects and other advantages will become apparent to those skilled in the art from the following detailed description taken with reference to the accompanying drawing.

DETAILED DESCRIPTION OF THE PREFERRED EMBODIMENT

Figure 1:
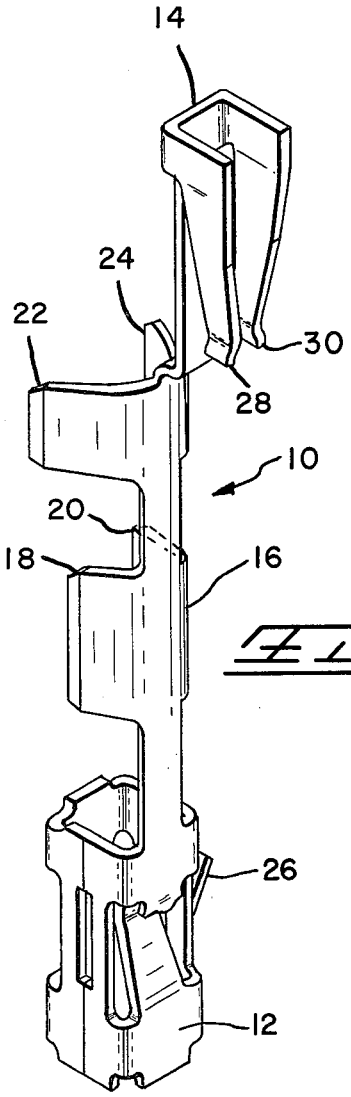
FIG. 1 is a perspective view of an electrical terminal according to the present invention.

The subject electrical terminal 10 is a double ended terminal with a mating receptacle portion 12 on one end and a probe receiving receptacle 14 on the opposite end. The intermediate portion of the terminal 16 is a wire barrel having a pair of first crimp ears 18, 20, adapted to engage the wire portion of a conductor, and a pair of insulation engaging strain relief ears 22, 24. The mating receptacle portion is of a well known configuration and is fully described in U.S. Pat. Nos. Re. 26,646 and 26,837, the disclosures of which are incorporated herein by reference. This portion of the terminal is a fully enclosed receptacle having anti-overstress features to prohibit deflecting the beams past their elastic limits causing permanent set in the beams and also includes a locking lance 26. The probe receptacle 14 on the opposite end is channel shaped and formed by a pair of upstanding, spaced cantilever beams 28, 30. The beams 28, 30 are preferably bent from the plane of the terminal to extend in the opposite direction from the mating receptacle portion 12 and the wire barrel 16.

Figure 2:
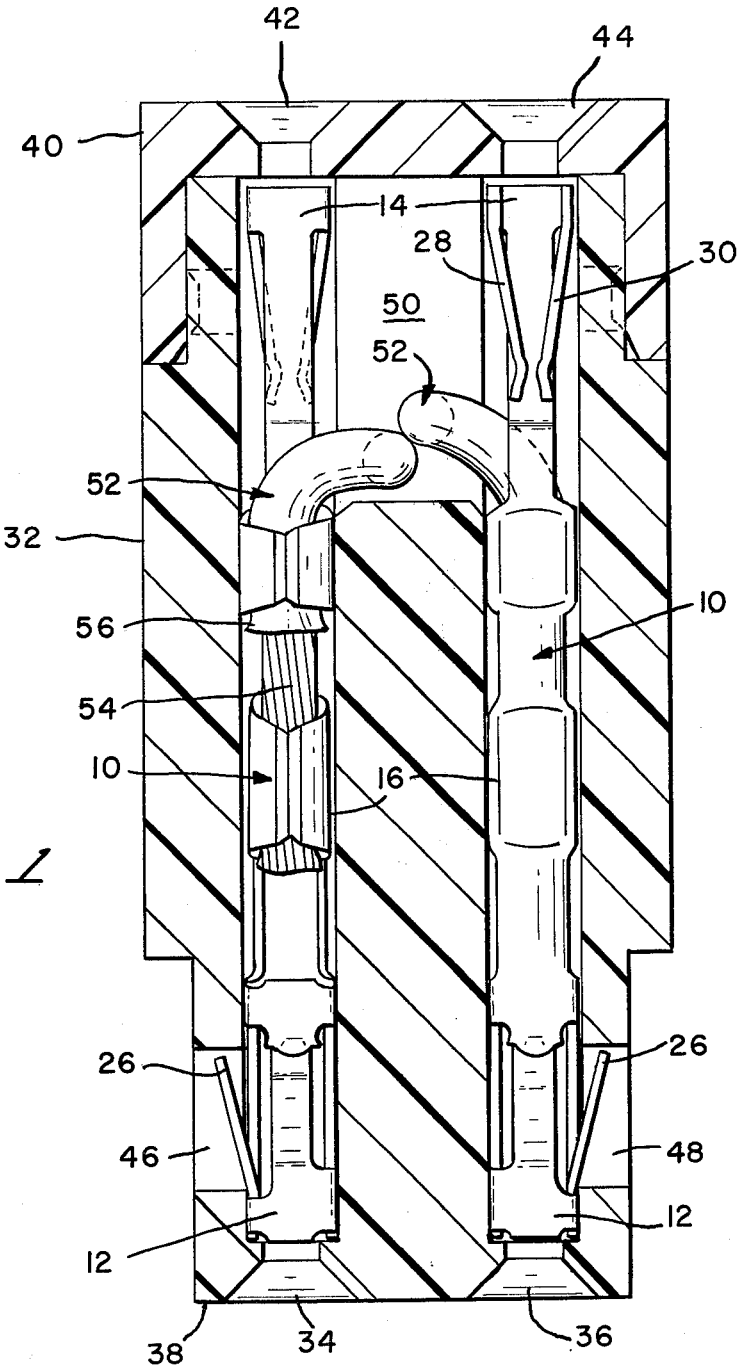
FIG. 2 is a transverse section through an electrical connector having the subject terminal mounted therein.

The subject terminal is preferably mounted in a housing of the type shown in FIG. 2 which housing comprises a body 32 having a plurality of terminal passages 35, 36 therein opening on a mating face 38. The opposite side of the housing 32 is enclosed by a cover 40 having apertures 42, 44 therein with each of the apertures being aligned with a respective passage. The passages are also intersected by apertures 46, 48 and open into a rearwardly directed central channel 50. Both the openings of the passages on the mating face and the apertures in the cover are sized to restrict the size of terminal pins and probes, respectively, inserted therein. This also serves to prevent overstressing of each receptacle portion 12, 14.

It will also be noted from FIG. 2 that each terminal 10 is crimp connected to a respective conductor 52 in conventional fashion with the ears 18, 20 engaging the wire 54 and the crimp ears 22, 24 engaging the insulation 56. The terminals are then inserted into the appropriate passage 34 with the locking lances 26 emerging through the respective apertures 46, 48 to secure the terminals in position. The conductors are then run through the central channel 50 to exit from an appropriate end of the connector housing. The rear cover 40 is fitted on the connector housing with the apertures 42, 44 aligned with the respective passageways 34, 36 and likewise with the respective probe receptacle portions 14 of the terminals 10. The probe receptacle 14 of each terminal 10 is thus accessible through the rear cover 40 of the connector.

It should be noted that by having the crimp barrel 16 and the probe receptacle portion 14 on opposite sides of the plane of the terminal, disruption of the crimp connection by an over length probe is prevented. The housing 32 can be provided with a shoulder (not shown) in the passages 34, 36 which can serve either as a stop for the probe receptacle portion 14 or for the probe (also not shown) or both.

The present invention may be subject to many modifications and changes without departing from the spirit or essential characteristics thereof. The present embodiment is therefore intended in all respects to be illustrative and not restrictive of the scope of the invention.

What is claimed is:

1. A double entry electrical terminal capable of being probed while in a mated condition comprising:

an elongated terminal member;

a mating receptacle on one end;

a probe receptacle on the opposite end; and an intermediate crimp barrel.

2. A double entry electrical terminal according to claim 1 further comprising a locking lance adapted to secure said terminal in a housing.

3. A double entry electrical terminal according to claim 1 wherein said crimp barrel comprises:

a first pair of conductor engaging tines; and a second pair of insulation engaging strain relief tines.

4. A double entry electrical terminal according to claim 1 wherein said mating receptacle comprises:

a closed receptacle having a pair of beams each provided with anti-overstress means to prohibit deflecting the beams past their elastic limits and causing permanent set in the beams.

5. A double entry electrical terminal according to claim 1 wherein said probe receptacle comprises:

a pair of beams bent up from the plane of said member and defining a probe receiving channel therebetween.

6. In combination with an electrical connector having a housing with a plurality of terminal passageways extending therethrough from a mating face to a rearwardly directed channel and a rear cover having a like plurality of apertures therein each aligned with a respective passageway, said cover being adapted to enclose the rear of said housing, a double entry electrical terminal mounted in each said passageway allowing probing of the terminal while the connector is in fully assembled and mated condition, said double entry terminal comprising:

an elongated metal member having a mating receptacle portion on a first end, said mating receptacle portion being engageable with a mating member;

a probe receptacle on the opposite end; and a crimp barrel intermediate said ends, said crimp barrel being engageable with a conductor, said probe receptacle and said crimp barrel lie on opposite sides of the plane of said terminal whereby an overlength probe inserted into said probe receptacle cannot interfere with the crimp connection.

7. The combination according to claim 6 further comprising a locking lance adapted to secure said terminal in said housing.

8. The combination according to claim 6 wherein said crimp barrel comprises:

a first pair of conductor engaging tines; and a second pair of insulation engaging strain relief tines.

9. The combination according to claim 6 wherein said mating receptacle comprises:

a closed receptacle having a pair of beams each provided with anti-overstress means to prohibit deflecting the beams past their elastic limits and causing permanent set in the beams.

10. The combination according to claim 6 wherein said probe receptacle comprises:

a pair of beams bent up from the plane of said member and defining a probe receiving channel therebetween.

* * * * *

UNITED STATES PATENT OFFICE

CERTIFICATE OF CORRECTION

Patent No. 4,342,495 Dated August 3, 1982

Inventor(s) BENNY M. BENNETT ET AL

It is certified that error appears in the above-identified patent and that said Letters Patent are hereby corrected as shown below:

Column 3, Line 24, after "end" insert - - - engageable with a mating member; - - - .

Column 3, Line 26, after "barrel" insert - - - engageable with a conductor, said probe receptacle and said intermediate crimp barrel lying on opposite sides of the plane of said terminal whereby an overlength probe inserted into said probe receptacle cannot interfere with the crimp action of said crimp barrel. - - - .

Signed and Sealed this

*Twenth-eighth* Day of *September 1982*

[SEAL]

*Attest:*

GERALD J. MOSSINGHOFF

*Attesting Officer* *Commissioner of Patents and Trademarks*